US009410372B2

(12) United States Patent
Hanuka

(10) Patent No.: US 9,410,372 B2
(45) Date of Patent: Aug. 9, 2016

(54) ALARM SYSTEM FOR ROLLING SHUTTERS

(71) Applicant: B.M.S. INVESTMENT GROUP (H.A.S.) LTD, Haifa (IL)

(72) Inventor: Benny Hanuka, Haifa (IL)

(73) Assignee: B.M.S. INVESTMENT GROUP (H.A.S.) LTD, Haifa (IL)

( * ) Notice: Subject to any disclaimer, the term of this patent is extended or adjusted under 35 U.S.C. 154(b) by 0 days.

(21) Appl. No.: 14/422,362

(22) PCT Filed: Oct. 3, 2013

(86) PCT No.: PCT/IL2013/000075
§ 371 (c)(1),
(2) Date: Feb. 19, 2015

(87) PCT Pub. No.: WO2014/057482
PCT Pub. Date: Apr. 17, 2014

(65) Prior Publication Data

US 2015/0218883 A1 Aug. 6, 2015

(30) Foreign Application Priority Data

Oct. 9, 2012 (IL) ..... 222296

(51) Int. Cl.

| | |
|---|---|
| ***G08B 13/22*** | (2006.01) |
| ***E06B 9/86*** | (2006.01) |
| ***E06B 9/15*** | (2006.01) |
| ***E06B 9/165*** | (2006.01) |
| ***E06B 9/58*** | (2006.01) |

(Continued)

(52) U.S. Cl.
CPC ... *E06B 9/86* (2013.01); *E06B 9/15* (2013.01); *E06B 9/165* (2013.01); *E06B 9/17* (2013.01); *E06B 9/56* (2013.01); *E06B 9/58* (2013.01); *G08B 13/22* (2013.01); *E06B 2009/1505* (2013.01); *E06B 2009/1538* (2013.01); *E06B 2009/1583* (2013.01); *G08B 13/00* (2013.01)

(58) Field of Classification Search
CPC ..... G08B 13/22
USPC ..... 160/10, 1, 7, 133; 49/13; 340/547, 548, 340/545.8
See application file for complete search history.

(56) References Cited

U.S. PATENT DOCUMENTS 3,009,138 A * 11/1961 Lindsay ..... G08B 13/181 105/394
3,668,582 A * 6/1972 Lea ..... G08B 13/08 200/61.93
3,696,373 A * 10/1972 Dunn ..... G08B 13/126 160/10

(Continued)

*Primary Examiner* — David Purol
(74) *Attorney, Agent, or Firm* — Mark M. Friedman

(57) ABSTRACT

An alarm system for rolling shutter comprised of plurality of alarm sensors is described. An alarm sensor is comprised of a conductive wire that is threaded within a slat and is connected in both sides to slat edge elements. The slat edge elements have a moving electrical contact that can be pulled out towards the inner wall of the shutter rail by a magnet. In selected heights along the rails, on both rails, a rail electric element comprising a magnet and a rail electrical contact are installed. A wire is connected from each rail electrical contact to an alarm control box. When the slat, which includes the slat-wire, is positioned in the same height as the rail electric elements, the moving contact on the slat makes a contact with the rail electric contact, thus creating a continuous electrical circuit from one rail electrical contact, through the slat, to the second rail electric contact. An attempt to move a slat, move the rails or cut the slat, will open the electrical circuit and generate an alarm, signal. An attempt to bypass the electrical circuit is detected by the change in the line resistance.

6 Claims, 7 Drawing Sheets

(51) Int. Cl.

| | |
|---|---|
| ***E06B 9/17*** | (2006.01) |
| ***E06B 9/56*** | (2006.01) |
| *G08B 13/00* | (2006.01) |

(56) References Cited

U.S. PATENT DOCUMENTS 4,160,972 A * 7/1979 La Mell ..... G08B 13/08 160/10
4,232,309 A * 11/1980 Dillitzer ..... G08B 13/08 109/21
4,706,726 A * 11/1987 Nortoft ..... E06B 9/32 160/168.1 P
5,440,289 A * 8/1995 Riordan ..... G08B 13/126 160/374
5,723,835 A * 3/1998 Gilmore ..... H01H 36/0033 200/61.71
5,777,552 A * 7/1998 Fischette ..... H01H 36/0046 335/206
5,964,058 A * 10/1999 Richardson ..... E05F 15/44 49/27
6,054,921 A * 4/2000 Miller ..... E06B 9/58 340/541
6,598,648 B1 * 7/2003 Schulte ..... E06B 9/13 160/1
7,034,682 B2 * 4/2006 Beggs ..... E06B 9/581 160/1

* cited by examiner

ALARM SYSTEM FOR ROLLING SHUTTERS

BACKGROUND OF THE INVENTION

1. Field of the Invention

The invention generally relates to alarm systems and specifically relates to alarm systems designed for rolling blinds.

2. Background Art

Rolling shutters are commonly used to cover windows, doors and other openings in private residences and in commercial buildings. They provide protection against intrusion and the resulting damage. A rolling shutter comprises the shutter frame, shutter rails, connected slats and a case that contains the rolled up connected slats. The slats are primarily made out of plastic or aluminum. The shutters open either manually or automatically. The rolling shutter can be partially closed; in that case, gaps remain between the honeycombed slats. There are two types of rolling shutters. One is a rolling shutter that is incorporated into the structure during construction, where the rails are physically connected to the structure and the shutter case is located inside the structure, this way there's no access to the rolling blinds case from the outside of the structure. The second type of rolling shutters is one that is mounted after the structure has been completed. In that case the rails are connected outside the structure and the shutter case is facing outside.

The rolling shutters provide a good solution for the covering of various windows, doorways and other openings. They also provide some protection against intrusion, but they are not resistant to a break in. It is possible to lift the slats from the outside. It is even possible to uproot the rails, in rolling shutters that are constructed after the structure has been completed. Portable battery powered power tools allow for the sawing of the slats, creating an opening allowing passage. Even the use of mechanical means designed to hinder intrusions, such as putting a lock on the bottom slat or adding a pin to guard from an outside lifting of the slats cannot prevent an intrusion. The rolling blinds are hindering intrusions, but cannot stop them. That's why an alarm system is needed, one that reports in the case of an intrusion attempt through the rolling shutter.

There are plenty of ways to add alarm sensors to a rolling shutter. The simplest way is to add a pushbutton at the bottom of the shutter frame. Normally the pushbutton is not pressed down and is its terminals are disconnected. When the rolling shutter is closed, the lowest slat presses the pushbutton, causing its terminals to be electrically connected. The pushbutton is connected to an alarm system that detects when the pushbutton is disconnects and operates the alarm. This method is not effective against an intruder who cuts the lowest slat, thus leaving the pushbutton pressed and fooling the system into thinking the shutter is closed. In other cases, a switch is operated by using a magnet that is attached to one of the rails, either on the inner or outer edge of the rail, and another magnet, which is attached to one of the slats; this alarm system also cannot detect an intruder who cuts the slats.

Patent application number DE4008441, titled "Roller shutter with transverse slats in side guides" describes a specialized rolling blind sensor, comprised of a two wires electrical cable that is threaded throw plurality of slats. The connection of the wires between each of the different slats is done by using a special connector. In the lowest slat the two wires of the cable are connected. The upper edges of the wires are connected through slip rings to the alarm system. The electric circuit will disconnect if an attempt will be made to cut the slats or to separate them; this system, though, does not provide warning in the case of an intruder who simply lifts the slats, and also does not provide a warning if a person forgot to lower the blinds altogether.

U.S. Pat. No. 6,054,921, titled "Alarm for a roll shutter assembly" describes a specialized sensor for rolling blinds that is based on a pressure sensor that is attached all along the shutter rail. This sensor does not identify the simple action of someone lifting the blinds and its installation is complex.

U.S. Pat. No. 4,232,309, titled "Roller shutter" describes a system based on magnetically operated switches. The switches are mounted inside the shutter rails in two different heights, one at the bottom and the other at the top of the rails. Fixed magnets are attached to the edges of the slats that will reach the same height as the magnets installed inside the rail when the shutter is closed. When the shutter is closed, the magnetically operated switches are activated, and generate closed current circuit. This system provides warning when attempt is made to lift the slats. However, it does not detect an attempt to cut the slats in the center of the shutter.

Hence, there is a need of a system that will provide reliable warnings against rolling blinds intrusion, in whatever method that intrusion is carried. This system should be easily installed over existing rolling blinds and should easily connect to existing alarm systems.

SUMMARY OF THE INVENTION

A rolling blinds system that incorporates alarm sensors, comprised of a shutter frame, slats that move vertically along two rails (that are a part of the shutter frame), and a number of alarm sensors that are integrated into the shutter frame.

An alarm sensor comprises a conductive wire that passes through the slat, with both ends of the wire attached to the edge of the slats. The two ends of the wire are connected to the slat terminals that include a moving electrical contact, a tab or a pin, which can be stretched out into the shutter rail by a magnet. The shutter rails contain, at appropriate heights, magnets and an electrical contact with a conductive wire that passes all the way from the electrical contact to shutter case at the top of the shutter frame. When a slat, containing the wire inside it, reaches the same height as the magnets and the electrical contact, the magnet pulls both sides of the wire and closes an electrical circuit that passes from one shutter rail to the other, through the slat. As such, it is clear that any attempt to lift the slat or to cut through it will cause the alarm to go off.

An alarm sensor based on this principle is installed inside several of the slats, and that will cause any intrusion attempt through the rolling shutter to cause the alarm to go off. The components of the alarm system are pre-installed into the slats and the shutter rails before the entire shutter is installed in the structure, and easily connects to any alarm system.

This system can provide warning on any type of intrusion, be it by the lifting of the slats, cutting the slats or otherwise disconnecting the slats from the rails. This alarm system cannot be neutralized.

BRIEF DESCRIPTION OF THE DRAWINGS

FIG. 5 shows the cross-section along a slat-sensor, with the sensor in disarmed state.

FIG. 6 presents cross-section along a slat-sensor with armed sensor.

FIG. 7 shows cross-section along a slat-sensor, with armed sensor, which includes line resistors.

FIG. 8 shows cross-section along a slat-sensor, with armed sensor that includes vibration sensor.

FIG. 12 shows the contact installed inside the shutter rail.

FIG. 12A shows the spring-loaded moving contact installed on the slat edge element of the slat.

DETAILED DESCRIPTION OF THE INVENTION

Figure 1:
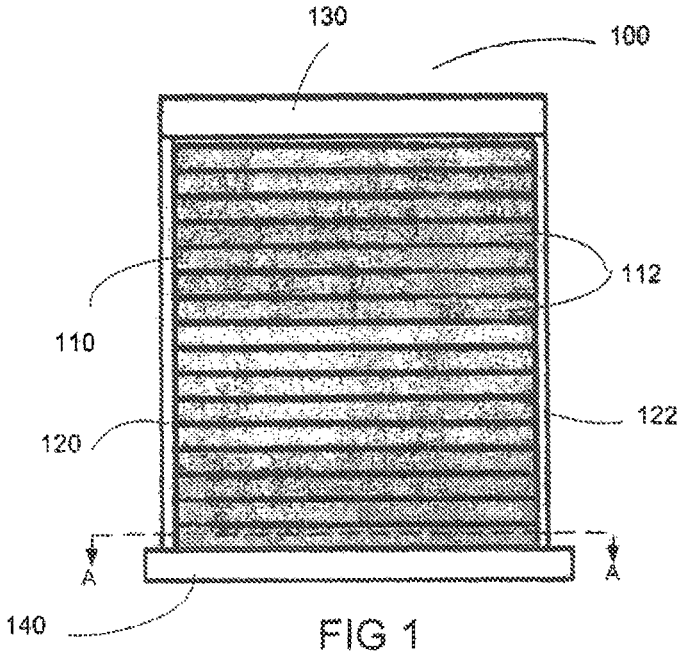
FIG. 1 shows the front view of a rolling shutter

This invention is described hereafter in detail, with relation to the attached figures, that describe one specific implementation of the system. It is important to note that it is possible to implement this patented system in many different ways, and the following description does not limit the possible implementations of systems that are based on this patent. On the contrary, the following implementation is designed to clarify the scope of the invention to experts in this particular field. A Rolling shutter that contain within itself an alarm system can be used to protect windows, doors, garages and other openings that require protection from intrusion. As an example, this description refers to a rolling shutter system that covers a window as shown in FIG. 1. The system described below will work the same with any rolling shutter that is similarly constructed.

FIG. 1 describes possible structure of a rolling shutter 100. The rolling shutter includes the shutter 110 comprised of plurality of slats 112 connected together by a slat connection element that allows the slats to be pivotally joined one to the other. Typically, slat's height is between 5 cm to 10 cm. The height of each slat and the flexibility of the connection element allow the slats to create a cyclical roll of slats, when they are raised. The width of the slats is fit the width of the covered opening. The slats are usually made out of aluminum or some other hardened plastic material, but can be built by any other suitable material. The rolling shutter structure includes a shutter case 130 located at the top most part of the structure, above the opening. The shutter case 130 holds the slats 110 when they are folded up, and houses the mechanism that enables the up and down movement of the slats. The structure of the rolling shutter contains pair of shutter rails, first shutter rail 120 and second shutter rail 122, and a lower element 140 on which the lowest slat rests when the shutter is closed.

Figure 2:
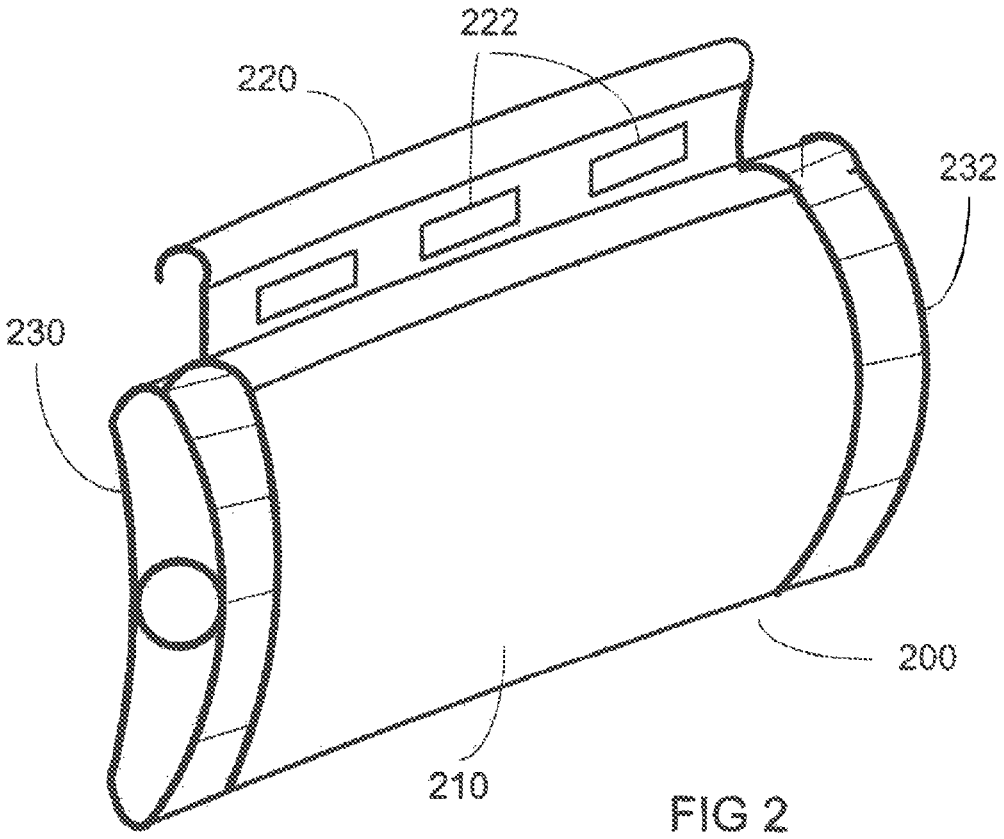
FIG. 2 shows the general structure of a slat of a rolling shutter

FIG. 2 describes a representative layout of a rolling shutter slat. The slat 200 is comprised of the slat body 210, to which the slat connection element 220 is connected. The slat connection element can have small holes 222 that allow the passage of light and air, when the shutter is not completely closed. Both sides of the slat contain slat edge elements, first slat edge element 230, and second slat edge element 232. The edge elements are usually made of plastic in order to reduce the friction between the slats and the shutter rails.

Figure 3:
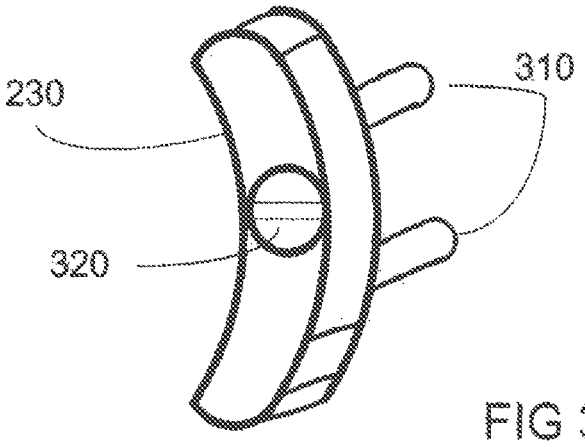
FIG. 3 shows the general structure of slat edge element of a rolling shutter slat.

A slat edge element is described in FIG. 3. The slat edge element is attached to the slat 210 by use of connection pins 310, screws 320 or any other connection means that can be disconnected.

Figure 4:
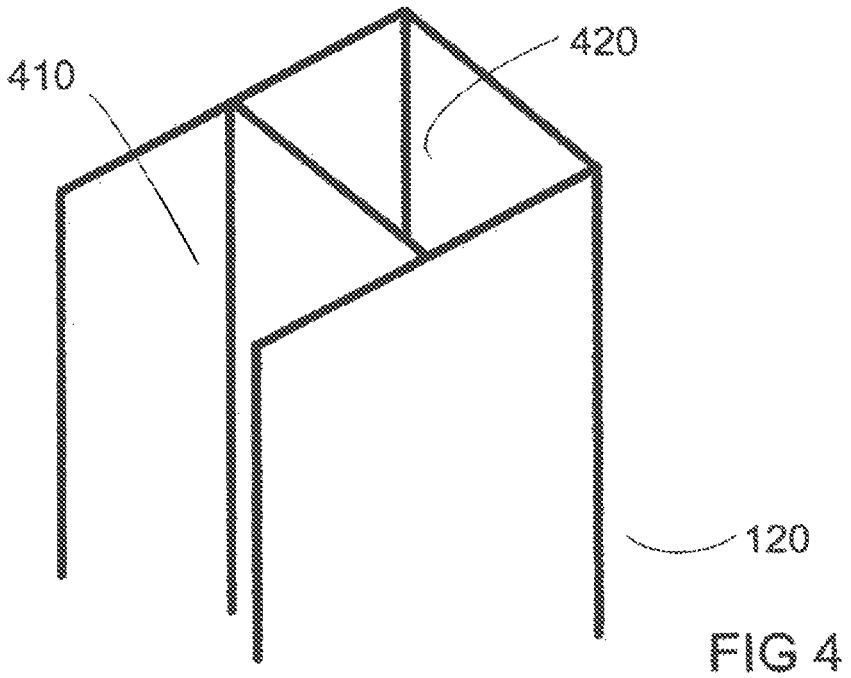
FIG. 4 shows structure of rolling shutter rail.

FIG. 4 describes structure of a shutter rail 400. The slats move in the rail groove 410. The shutter rail also contains an area that maintains a vertical space all along the rail 420.

Figure 4A:
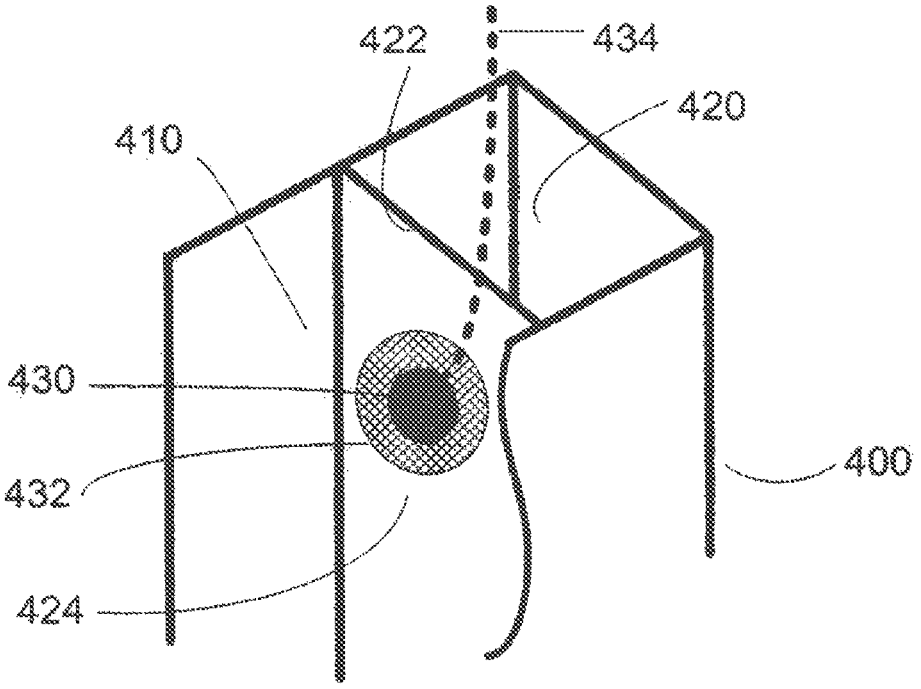
FIG. 4A show the fixed magnet and fixed contact installed in the rolling shutter rail.

FIG. 4A describes part of a shutter rail according to the invention. At a selected height inside the rail 400, on the inner wall 422 of the shutter rail 400, a rail electric element 424 comprised of a means for generation of magnetic field 432 and a rail electric contact 430, which is insulated from the rail, are installed. A wire 434, connected to the rail electric contact 430, passes through the rail space 420 all the way up to the top of the rail into the shutter case to the alarm control box. It is preferable to use fixed magnet for the generation of the magnetic field.

Figure 5:
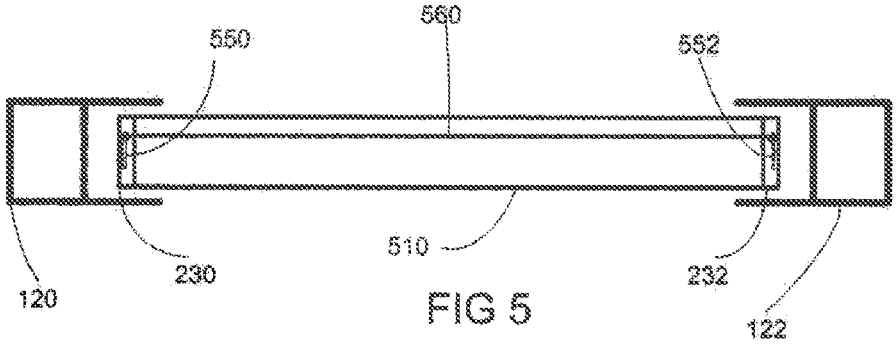
FIGS. 5-8 present horizontal cross-section along line A-A in FIG. 1, where

FIG. 5 presents a cross section A-A in FIG. 1 along the bottom slat that describes the structure of an alarm sensor fitted into a single slat; an element of the described invention. A shutter slat, which includes an alarm sensor, is referred to as sensor-slat. While this figure relates specifically to the last slat of the shutter, it is important to note that the same structure for sensors installation can be implemented on any of the slats, and in any number of the slats that comprise the shutter. That is to say that an alarm system according to the invention can have plurality of sensor-slats. Inside the sensor-slat, 510 there is a conductive isolated wire 560, referred to as slat-wire, which connects the two, magnetically operated, slat-moving contacts 550, 552 that are installed on the slats edge elements 230, 232. When not activated, the slat-moving contacts 550, 552 are held inside the slat edge element by holding means such as spring or a weak magnet.

The rail electric elements 424 presented in FIG. 4 are installed at the same heights on the first and second shutter rails. As long as the sensor-slat is not located at the height of the rail electric elements as shown in FIG. 5, the slat moving contacts 550, 552 remain inside the slat edge elements 230, 232.

Figure 6:
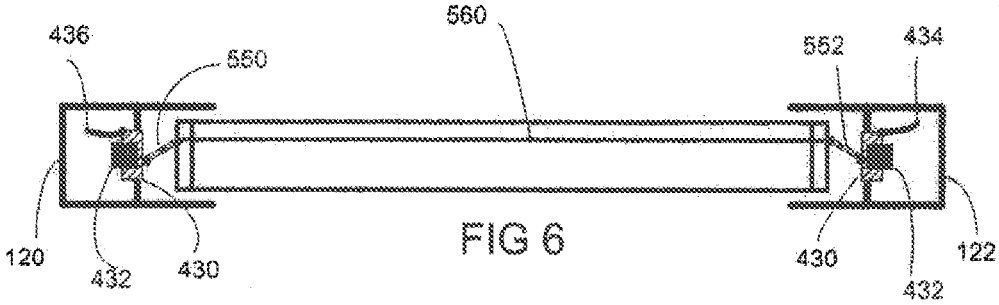

When the sensor-slat is positioned within the shutter rails at the same height as the rail electric elements, as shown in FIG. 6, the slat-moving contacts 550, 552 are pulled by the magnetic field produced by the rail electric element and touches the rail electric contact 430 of the rail electric element, 424. Thus, a continuous electric path is formed between wire 434 and wire 436. The electric path is created between the conducting wire 434 through the rail electric contact 430 in the second shutter rail 122, through the moving contact 552, the slat-wire 560, the slat-moving contact 550, the rail electric contact 430 mounted on the first shutter rail 120 and the conducting wire 436. Any attempt to move the sensor-slat from its place will cause the electric circuit to be opened because the slat-moving contact will be disconnected from the rail electric contact. In addition, any attempt to cut the sensor-slat will also cause the opening of the electric circuit.

Figure 7:
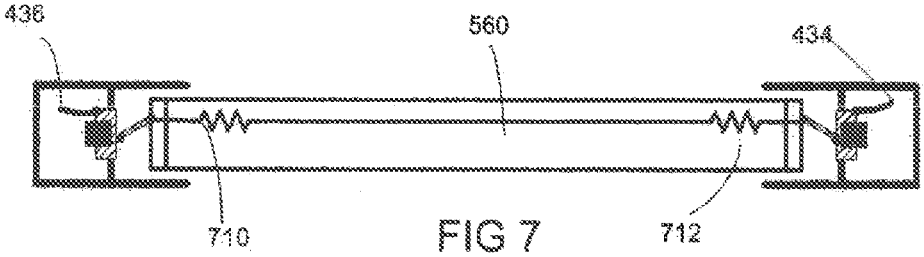

FIG. 7 shows another implementation of a sensor-slat. In this implementation, line resistors 710, 712 are connected in series to the slat-wire 560 *t*. It is also possible to connect just one line resistor. The purpose of the line resistors is to prevent an electrical bypass of the electric circuit that goes through the sensor-slat by shortening the circuit between the wire conductors 434 and 436. It should be noted that instead of connecting line resistors, a slat-wire made of resistance wire may be used.

Figure 8:
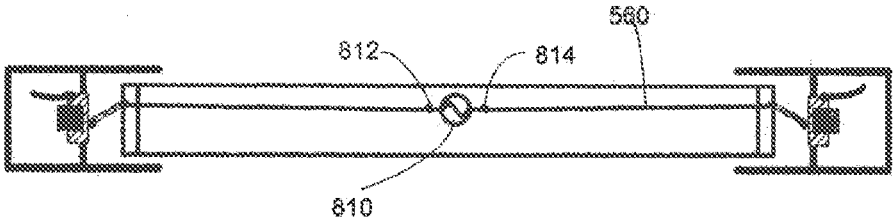

FIG. 8 shows another implementation of a sensor-slat. In this case, the slat houses a vibration sensor 810 in series to the internal electrical slat-wire 560. The vibration sensor is a normally closed switch when static, which is opened when shock of certain intensity is applied to it. The vibration sensor is sensitive to lifting, cutting, and shaking of the sensor-slat. When static, an electrical circuit is formed between the connection points 812, 814 of the vibration sensor 810. When engaged, the vibration sensor cuts the electric circuit.

It is important to note that it is possible to incorporate any combination of line resistors and a vibration sensor in a single sensor-slat.

Figure 9:
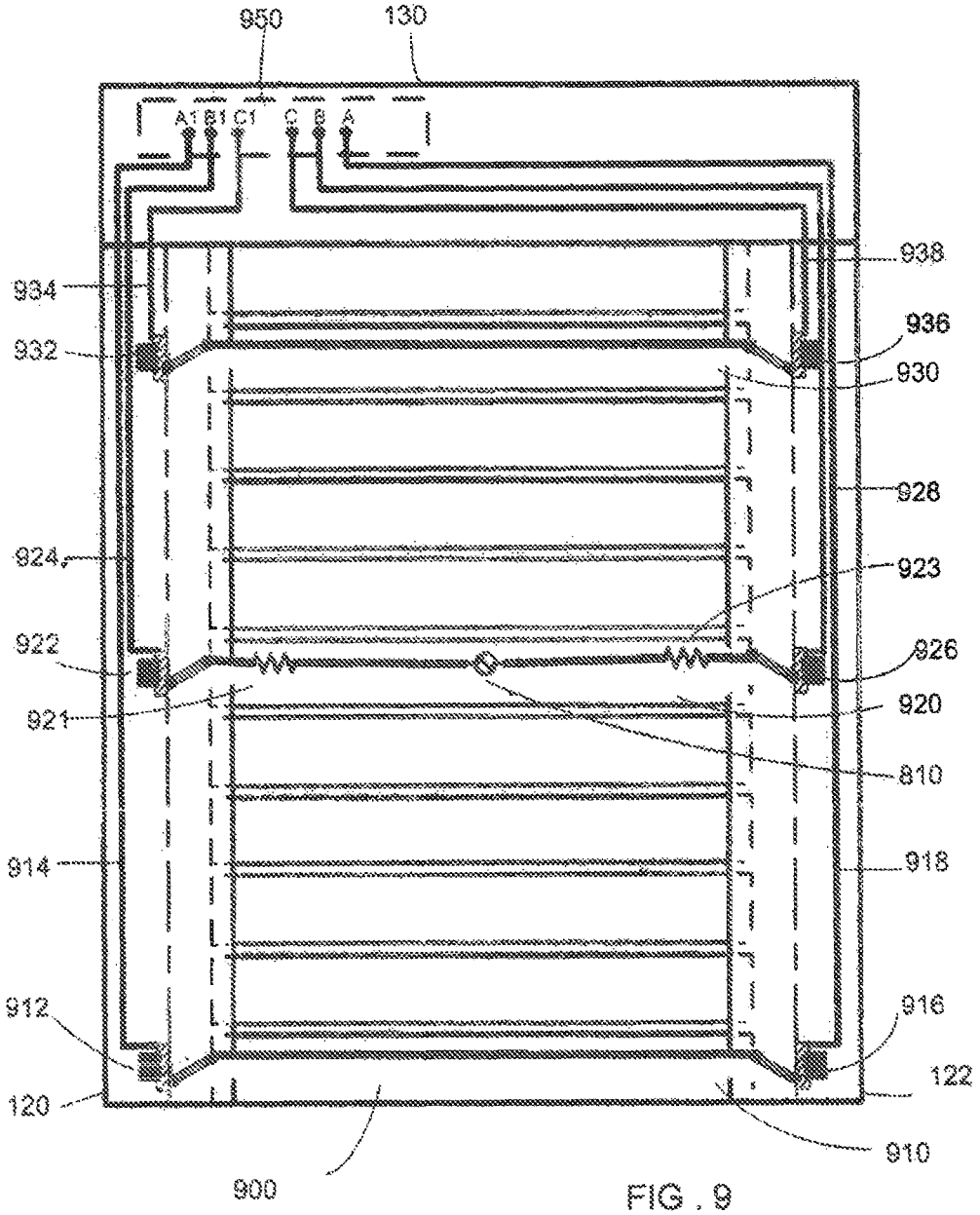
FIG. 9 presents one implementation of an alarm system comprised of three slat-sensors in alarmed state.

FIG. 9 shows one implementation of the rolling shutter alarm system using different combinations of slat-sensors that where shown in the preceding figures. A professional in this field will be able to build the different implementations of this system. The demonstrated alarm system 900 is constructed out of three sensor-slats that are embedded into the lowest slat 910, a middle slat 910, and the uppermost slat 930. At selected heights on the first shutter rail 120 and second shutter rail 122, rail electric elements are installed 912, 922, 932 and 916, 926, 936. The wires 914, 924 and 934 connected to the rail electric contacts of rail electric elements of the first shutter rail, 120 pass through the space in the rail up to the alarm control box 950 that is located in the shutter case 130 into connection points A1, B1 and C1 respectively. Similarly, the conductors 918, 928 and 938 are connecting the fixed contacts of the rail electric elements of the second shutter rail 122 to the alarm control box 950 and into the connection points A, B and C. The middle sensor-slat, in the presented implementation, includes line resistors 921, 923 and a vibration sensor 810.

The system is armed when all the sensor-slats are located at the selected heights, where the rail electric elements are positioned, and create an electrical circuit between connections points A, A1 and B, B1 and C, C1. It is possible to connect the alarm system to each sensor-slat individually, or connect them all in one line so that the alarm system will get only one sensor feed that combines all three sensors.

The alarm control box 950 can contain an electronic unit that coordinates between the slat sensor-slats and the alarm system, when one is already installed on the premises. Thus, if the alarm system cannot detect a change in circuit resistances, the electronic unit will assume this function and will transfer the warning signal to the alarm system. It cans also house the electronics that sounds the alarm in case of sensor activation.

Figure 10A:
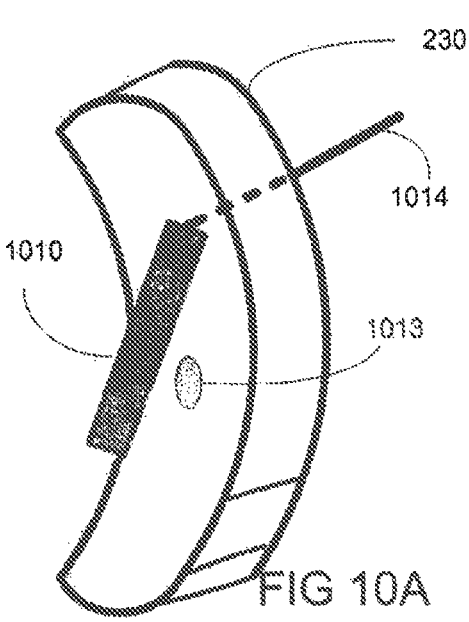
FIG. 10A shows a slat edge element of a slat-sensor, where the magnetically operated leaf moving contact is armed.
Figure 10:
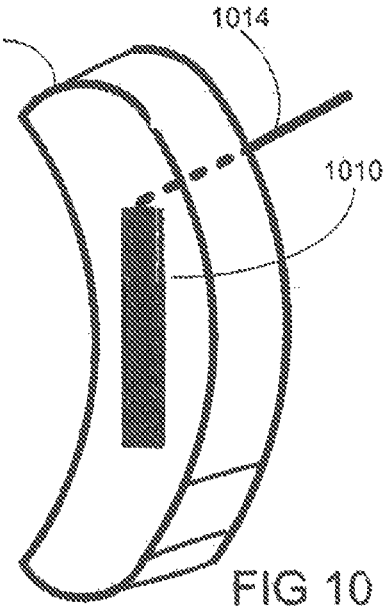
FIG. 10 shows a slat edge element of a slat-sensor where the magnetically operated leaf moving contact is disarmed.

FIGS. 10 and 10A show an implementation of the magnetically operated leaf moving contact built in the slat edge element. These figures show the moving contact in both positions (armed and unarmed). FIG. 10 shows the moving contact 1010 in its closed position (when not armed) where it is pressed to the slat edge element. FIG. 10A shows the moving contact 1010 after it has been pulled by the magnet that is located on the shutter rail (in activated state). Furthermore, this figure shows the little magnet 1013 located on the slat cover that keeps the moving contact pressed to the slat edge element when no outside force is applied. A spring can be used to replace the magnet, as well as any other comparable component. A conductor is attached to the moving contact 1014.

Figure 11A:
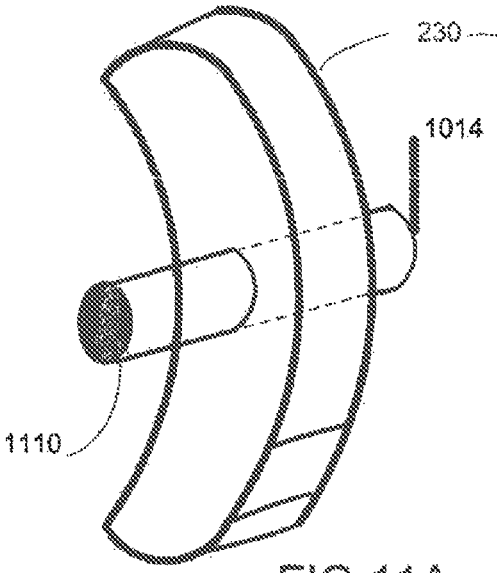
FIG. 11A shows a slat edge element of a slat-sensor with armed, magnetically operated cylindrical moving contact.
Figure 11:
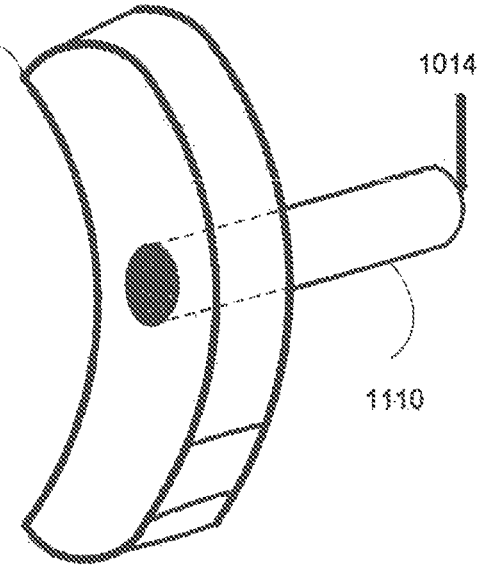
FIG. 11 shows a slat edge element of a slat-sensor with unarmed, magnetically operated cylindrical moving contact.

FIGS. 11, 11A show another implementation of the moving contact. The moving contact is cylindrically shaped 1110. FIG. 11 shows the cylindrical contact held inside the slat edge by a spring, or some other means. FIG. 11A shows the contact or (1110) after the magnet inside the rail electric element has pulled it.

Figure 12:
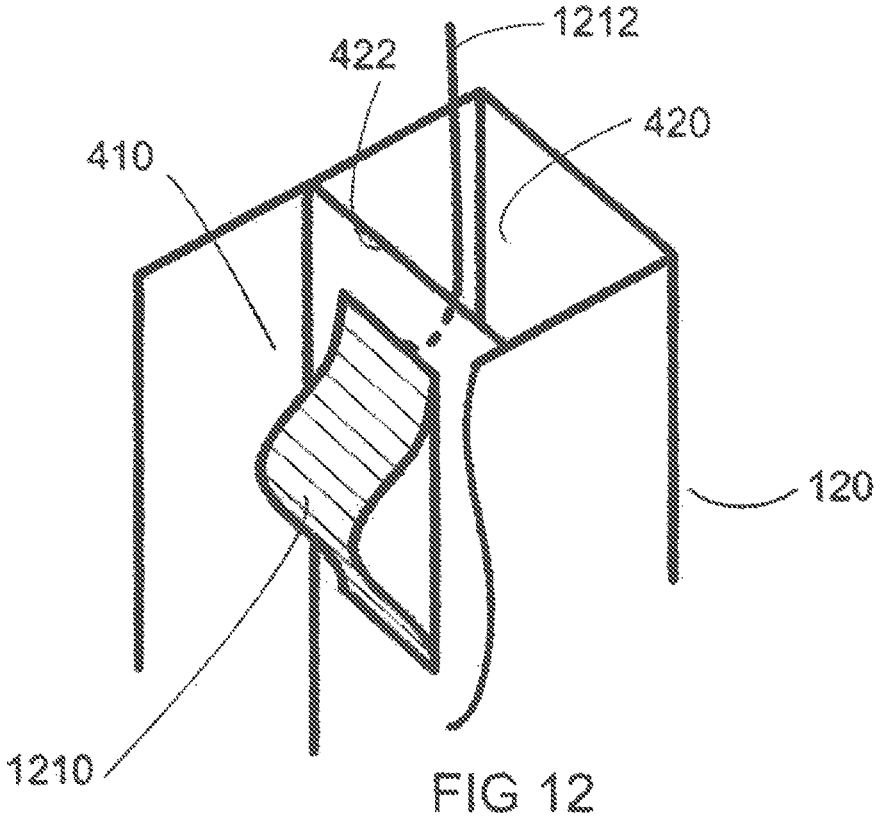
FIGS. 12, 12A show an alternative implementation of the slat edge element and the shutter rail element, where.
Figure 12A:
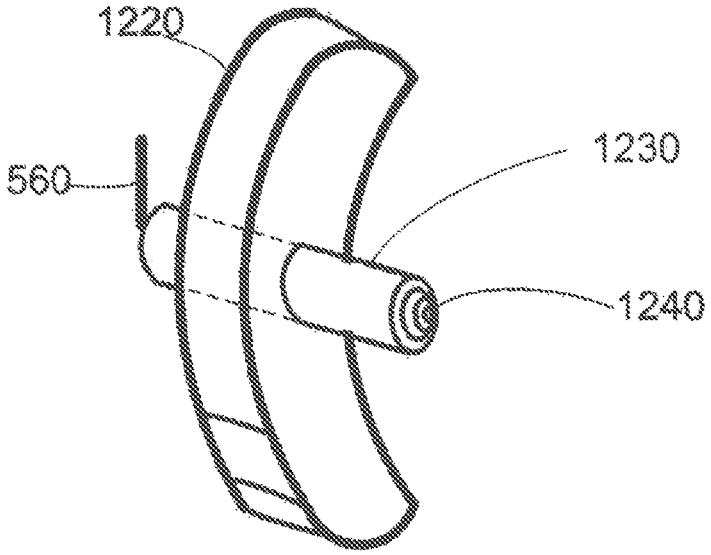

FIGS. 12, 12A show another implementation of the shutter rail electric element and the moving contact. FIG. 12 show the shutter rail 400, inside of which a spring electrical contact 1210 isolated from the rail, is installed. A wire 1212 connects the spring electrical contact to the alarm control box. FIG. 12A shows the slat edge element 1220 that contains a conductive pin 1230, with a spherical tip 1240. The other end of the pin is connected to slat-wire 560 that passes through the sensor-slat. The pin is extending from the slat edge element by a spring so it touches the inner wall 422 of the shutter rail 400, and it can easily move along the length of the rail. When the pin moves along the wall of the rail, it makes a contact with the spring electric contact 1210, thus closing the electrical circuit.

What is claimed is:

1. An alarm system embedded in a rolling shutter, the alarm system is comprised of:

a) Two vertical shutter rails;

b) at least one pair of rail electric elements mounted on the inner wall of each of the shutter rails, where said rail electric elements are mounted at the same height on both rails, where said rail electric element is comprised of means for the generation of magnetic field and rail electric contact;

c) a shutter comprised of plurality of interconnected slats where each slat is comprised of slat body and two slat edge elements, where said elements slide in the shutter rails;

d) at least one slat of the shutter is a sensor-slat comprised of edge elements which includes slat moving contact capable of moving horizontally by a magnet and a slat-wire, passing within the slat body, connected to both moving contacts; the sensor-slat is configured to be vertically displaced along the shutter rails such that the moving contact are vertically displaced with respect to the rail electric elements; the slat-wire and the slat moving contacts are electrically isolated from the slat's body and edge elements each of the moving contacts are configured to be electrically coupled to one of the rail electric elements; and e) an alarm control box comprised of electric terminals and means for detecting discontinuity in electric circuit; the alarm control box is electrically connected to each of the rail electric contacts, such that when the sensor-slat is disposed at the height of the rail electric elements, an electric circuit is formed between the rail electric elements and the slat-wire.

2. An alarm system as stated in claim 1 wherein the slat-wire of at least one sensor-slat, has electric resistance and the alarm control box includes means for detecting change in circuit resistance.

3. An alarm system as stated in claim 1 wherein within at least one sensor-slat a vibration sensor is connected in series with the slat-wire, and the alarm control box includes means for detecting rapid changes in electric circuit.

4. An alarm system installed in a rolling shutter, the alarm system is comprised of:

a) Two vertical shutter rails;

b) at least one pair of rail electric elements mounted on the inner wall of each of the shutter rails, where said rail electric elements are mounted at the same height on both rails, where said rail electric element is comprised of rail electric contact;

c) a shutter comprised of plurality of interconnected slats where each slat is comprised of slat body and two slat edge elements, where said elements slide in the shutter rails;

d) at least one slat of the shutter is a sensor-slat, comprised of edge elements which includes slat moving contact capable of moving horizontally and a slat-wire, passing within the slat body, connected to both moving contacts; the sensor-slat is configured to be vertically displaced along the shutter rails such that the moving contact are vertically displaced with respect to the rail electric elements; the slat-wire and the slat moving contacts are electrically isolated from the slat's body and edge elements each of the moving contacts are configured to be electrically coupled to one of the rail electric elements; and e) an alarm control box comprised of electric terminals and means for detecting discontinuity in electric circuit, the alarm control box is electrically connected to the rail electric contacts such that when the sensor-slat is disposed at the height of the rail electric elements, an electric circuit is formed between the rail electric elements and the slat-wire.

5. An alarm system as stated in claim 4 wherein the slat-wire of at least one sensor-slat has electric resistance and the alarm control box includes means for detecting change in circuit resistance.

6. An alarm system as stated in claim 4 wherein within at least one sensor-slat a vibration sensor is connected in series with the slat-wire, and the alarm control box includes means for detecting rapid changes in electric circuit.

* * * * *